United States Patent [19]

Wickham

[11] 4,268,989

[45] May 26, 1981

[54] BUOYANT DEVICE WITH MEANS FOR PRODUCING THRUST

[76] Inventor: David J. Wickham, 13 Conway Rd., Chippenham, Wilts., England

[21] Appl. No.: 972,871

[22] Filed: Dec. 26, 1978

[51] Int. Cl.[3] ..... A63H 23/04; A63H 23/10

[52] U.S. Cl. ..... 46/92

[58] Field of Search ..... 46/91, 92, 93, 94, 95, 46/76 A, 56; 273/1 P; 272/8 N

[56] References Cited

U.S. PATENT DOCUMENTS

| | | | |
|---|---|---|---|
| 2,076,428 | 4/1937 | Drudy et al. | 46/95 |
| 2,314,057 | 3/1943 | Slotsky et al. | 46/95 |
| 2,511,323 | 6/1950 | Briggs et al. | 46/95 |
| 2,524,059 | 10/1950 | Kennedy | 46/56 |
| 2,649,804 | 8/1953 | Kennedy | 46/91 X |
| 2,857,709 | 10/1958 | Weiland | 46/95 |
| 3,254,441 | 6/1966 | Bramson | 46/92 |

FOREIGN PATENT DOCUMENTS

| | | | |
|---|---|---|---|
| 657263 | 5/1929 | France | 46/95 |
| 291614 | 12/1931 | Italy | 46/95 |
| 454015 | 1/1950 | Italy | 272/8 N |
| 1165449 | 10/1969 | United Kingdom | 46/95 |

*Primary Examiner*—F. Barry Shay

*Attorney, Agent, or Firm*—Larson, Taylor and Hinds

[57] ABSTRACT

A floatable toy has a body which even when filled with water is inherently buoyant, has an aperture for readily filling with water and when floating in the level of the water within is higher than the level of surface upon which the body floats and having restrictive flow passages from the interior to the exterior to below the surface to produce rotational or other movement.

6 Claims, 2 Drawing Figures

Figure 1:
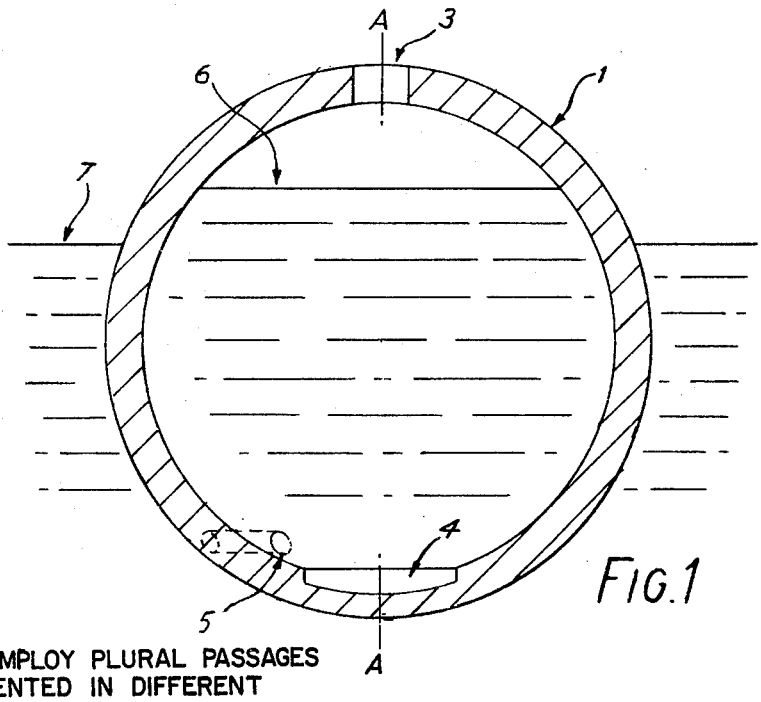

MAY EMPLOY PLURAL PASSAGES 5 ORIENTED IN DIFFERENT DIRECTIONS AND AT DIFFERENT LEVELS

BUOYANT DEVICE WITH MEANS FOR PRODUCING THRUST

This invention relates to buoyant devices and more particularly but not exclusively to novelties or toys.

According to the present invention, there is provided a floatable device including a body formed as a cavity and which, even when filled and submerged in a specific liquid (preferably water), displaces more than its own weight of the liquid, the cavity having an opening for introducing liquid thereto, a restrictive flow passage between the cavity and the exterior thereof, said passage being arranged to produce an other than vertical thrust component on the body as a result of outward flow due to excess head of liquid inside the cavity over that outside the device when floating.

The invention preferably further provides a rotatingly floatable device including a body which floats in a specific liquid with a predetermined attitude and within generally circular horizontal confines of which body in said attitude there is provided a cavity and an opening for introducing liquid thereto at least one restrictive flow passage between the cavity and the exterior thereof, the or each said passage being arranged to produce a rotational thrust component due to the excess head of liquid inside the cavity over that outside the device.

Preferably, the body may be formed in the main of plastic foam material which provides it with a requisite inherent buoyancy.

The body may also be readily formed to have a varied wall thickness which enables the device to have an internal stabilizing recess to provide it with an inherent floating stability by virtue of the tendency for liquid therein to adopt its lowest natural level in such a recess.

The body may be formed to have a generally spherical configuration, the passage between the cavity and the exterior being arranged to produce a said rotational component on the body or the body may be arranged to have a longitudinal shape such, for example, as a model submarine. In the latter, the passage between the cavity and the exterior thereof may then produce a longitudinal driving thrust tending to drive the model along in the liquid.

In order that the invention may be more clearly understood, it will now be described by way of one example with reference to the accompanying drawing which illustrates the general principles of the invention as applied to a generally spherical body, but it will be appreciated from the foregoing that the invention is by no means limited to such a body.

Referring to the drawing, which shows a child's bathtime toy, a hollow sphere is moulded in expanded plastic foam and comprises two identical halves fixed together to make up a complete sphere as illustrated with an internal cavity 2, a filling port 3, two discharge passages 5 and a stabilizing recess 4.

To initiate a cycle of operation, the sphere 1 is forcibly submerged beneath a water surface 7 (in which it can float) allowing the water to enter cavity 2 mainly through port 3. When released, the sphere rises to take up a floating position similar to that shown in the drawing with the cavity 2 at least partially below the level of the water in which the sphere now floats, the relative positions of surface 7 with sphere 1 and the surface 6 of the water in cavity 2 being dependent on the amount of filling. The stabilizing recess 4 is provided to cause sphere axis AA to tend to maintain a substantially vertical position with port 3 at the top throughout the cycle.

The water surface 6 is maintained at a higher level than the water surface 7 by means of the buoyancy created by the expanded plastic foam wall of the sphere and as a result, flow takes place from cavity 2 through passages 5 into the water in which the device floats. The device rises progressively to tend to maintain a head of water in the cavity 2. Passages 5 are so orientated as to produce a thrust moment causing rotation of the sphere about axis AA. Rotation may then continue until the sphere has risen relative to surfaces 6 and 7 to a point where no further flow can take place through passages 5.

In the preferred manner of manufacture of the above described bathtime toy, sheets of polystyrene are vacuum formed to produce generally hemispherical halves. These halves are then provided with close-fitting generally hemispherical buoyant liners pre-formed by a well-known expanded plastic moulding technique in which pre-expanded granules are introduced into a mould prior to final steam-expansion. The liners are retained by a suitable contact adhesive and the halves are then cut from the mother sheet and brought together with a suitable adhesive or connecting band to form a neat joint.

In order to enhance the visual effect and entertainment value of the device as a bathtime toy, although not shown, the outside of the device is decorated, for example, with performing dolphins. Such decoration is readily achieved in manufacture with the above preferred method of construction, since the polystyrene sheets are readily pre-printed with decorative forms, allowing for the subsequent distortion due to the vacuum forming.

It is particularly appropriate to the action and nature of the device, which rotates while rising relatively slowly in the water, to mark the outside with objects, creatures or motifs, which rise in the water and/or take off from water e.g. fish and especially flying fish, aquatic mammals, reptiles and monsters, mythical aquatic creatures, birds, submarines, aircraft and especially seaplanes and flying boats and underwater launched rockets. Such markings may be substantially permanent or may be replaceable as with, for instance, transfers.

Another aspect of the invention relates to creatures or craft generally of an aquatic nature and modelled in expanded plastic foam. This aspect, whilst not illustrated, is so formed as to provide the internal cavity and adequate stability at the same time as having the external shape of the relevant craft or creature. The thrust generated in this case is normally though not exclusively directed so as to cause a forward movement.

In other aspects of this invention the device may be maintained in a stable, upright position, with the aid of weights placed in a low position, these also serving to affect the level at which the device floats.

A plurality of passages may be provided with a variety of orientations and set at different levels in the device such that as passages rise above the surface of the liquid the movement of the device changes. Passages may be made adjustable or pluggable to enable the movement of the device to be changed or adjusted between cycles.

In a further embodiment of the rotating aspect of this invention the device is constrained, for example by a central bearing or by guiding means acting on the outside surface, so that only rotational and vertical movements are possible.

Additionally, the liquid in which the device floats may be contained in a closed or partially closed vessel. In the case of a closed vessel, filling of the device may be suitably arranged to be effected by temporary inversion of the vessel.

In an adaptation of the invention as described above with reference to the drawing, the aperture 3 might be reduced simply to an air vent and a further aperture may be introduced at the lowest point of the axis A.A. The diameter of this further aperture may be such as to provide a close bearing fit on a vertically fixed supply tube. By supplying water at a steady rate to the supply tube the device will then effect continuous rotation for as long as the supply is maintained. In such an adaptation the invention can find application to garden ornaments or window displays.

Figure 2:
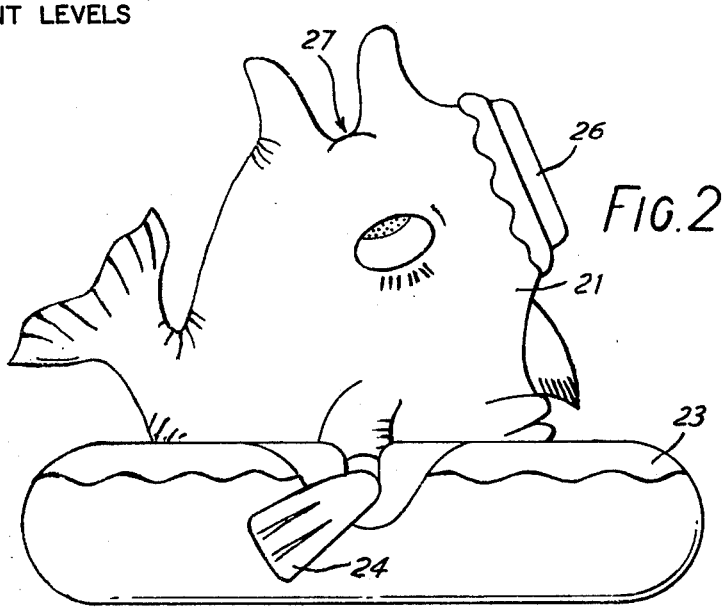

An alternative design for a floatable device also being a child's bathtime toy, is shown in side view in FIG. 2. A hollow dolphin fish formed of moulded plastics material, is denoted by reference 21, carried in an annular buoyant readily rotatable float 23. Extending laterally from the dolphin are ornamental paddle-like members, one of which is shown at 24 and another of which is provided diametrially opposite thereto in relation to the annular float. The paddle-like members 24 are provided with tubular inserts which communicate with the inside of the body of the fish to provide directional jets to effect rotation of the toy. The mouth 27 of the dolphin is provided with an opening through which a child can readily fill the body of the fish with water, the level of which is substantially higher than the level of the water within which the float 23 is buoyantly supported. Alternatively, the hat 26 of the dolphin may be provided with an aperture for filling. The paddles 24 dip into the water surface and are directed in a like rotational direction, this and the head of water in the dolphin in operation causes rotation of the toy similarly to the toy of FIG. 1, until the level of water in the body of the fish has descended to a level at which significant flow from the ends of the paddles 24 ceases.

Having thus described my invention what I claim is:

1. A floatable device comprising a body of a generally convex shape formed with a cavity defined by an outer shell of bouyant material, said shell being provided with means such that the body will float in water stably wherein said cavity is filled with water, said means being a recess at the bottom of the inner surface of said shell, the cavity having an upper relatively large, continuously open aperture opposite said recess and a lower aperture forming a restrictive flow passage between the cavity and the underwater level when the body is floating in water, said passage being oriented to produce a thrust component for causing the floating body to rotate in the water when the internal water level in the cavity is higher than the external water level, the buoyancy being such as to cause the floating body to rise progressively in the water as water in the cavity flows out through said lower aperture so as to tend to maintain a head of water in the cavity above the external water level.

2. A floatable device as claimed in claim 1 the body being formed in the main of plastic foam material.

3. A floatable device as claimed claim 1, the body being formed by adding a buoyant liner to an outer vacuum formed plastic shell.

4. A floatable device as claimed in claim 1, the device comprising an annular float which supports a container providing said cavity and shaped to dipict a fish.

5. A floatable device as claimed in claim 4, the restricted flow passage or passages being provided via the tips of ornamental paddles extending from the periphery of the annular float.

6. A floatable device comprising a body formed with a cavity defined by an outer shell of buoyant material such that the body will float in water with a given attitude even when filled with water, the cavity having an upper relatively large, continuously open aperture and lower apertures forming a plurality of restrictive flow passages between the cavity and the underwater level when the body is floating in water, said passages being at different levels and oriented to produce thrust components for causing the floating body to move in the water and produce different motions for different floatation levels when the internal water level in the cavity is higher than the external water level, the buoyancy being such as to cause the floating body to rise progressively in the water as water in the cavity flows out through said lower apertures so as to tend to maintain a head of water in the cavity above the external water level.

* * * * *